US012606218B2

(12) United States Patent
Monteiro

(10) Patent No.: US 12,606,218 B2
(45) Date of Patent: Apr. 21, 2026

(54) ROPEWAY TRANSPORT SYSTEM

(71) Applicant: Andre Fraser Monteiro, Littleport (GB)

(72) Inventor: Andre Fraser Monteiro, Littleport (GB)

( * ) Notice: Subject to any disclaimer, the term of this patent is extended or adjusted under 35 U.S.C. 154(b) by 620 days.

(21) Appl. No.: 18/000,032

(22) PCT Filed: Jun. 1, 2021

(86) PCT No.: PCT/GB2021/051343

§ 371 (c)(1),
(2) Date: Nov. 28, 2022

(87) PCT Pub. No.: WO2021/245400

PCT Pub. Date: Dec. 9, 2021

(65) Prior Publication Data

US 2023/0211811 A1 Jul. 6, 2023

(30) Foreign Application Priority Data

Jun. 1, 2020 (GB) ..... 2008219

(51) Int. Cl.
*B61B 10/00* (2006.01)
*B61B 7/06* (2006.01)
(Continued)

(52) U.S. Cl.
CPC ..... *B61B 10/005* (2013.01); *B61B 7/06* (2013.01); *B61B 10/022* (2013.01); *B61B 10/025* (2013.01); *B61B 12/06* (2013.01)

(58) Field of Classification Search
CPC ..... B61B 10/005; B61B 7/06; B61B 10/022; B61B 10/025; B61B 12/06
See application file for complete search history.

(56) References Cited

U.S. PATENT DOCUMENTS 3,541,962 A * 11/1970 Avery ..... B61K 1/00 104/178
3,871,303 A 3/1975 Woodling
(Continued)

FOREIGN PATENT DOCUMENTS

EP 0179708 4/1986
EP 0179708 A1 * 4/1986 ..... B61B 12/10
(Continued)

OTHER PUBLICATIONS

UK IPO, Search Report under Sec. 17 for Application No. GB2008219.4, dated Nov. 10, 2020, 1 pages.
(Continued)

*Primary Examiner* — Jason C Smith
(74) *Attorney, Agent, or Firm* — Smith Keane LLP

(57) ABSTRACT

A ropeway or cable system is disclosed having at least two cable loops (1,20) that form a track, a first loop extending directly between two end station embarking or disembarking stations of the track, and a second loop extending between the two end stations via intermediate embarking or disembarking stations) or turning towers on the track. A vehicle (2) is carried from a loop, the vehicle (2) having a cable gripping mechanism (37, 38, 43, 44), the cable gripping mechanism being capable of switching attachment of the vehicle between two or more cable loops (1,20), so as to change the loop that carries the vehicle (2).

7 Claims, 13 Drawing Sheets

(51) Int. Cl.
*B61B 10/02* (2006.01)
*B61B 12/06* (2006.01)

(56) References Cited

U.S. PATENT DOCUMENTS

| | | | | |
|---|---|---|---|---|
| 4,508,205 | A * | 4/1985 | Aulagner | B61B 15/00 198/794 |
| 5,172,640 | A | 12/1992 | Cathiard | |
| 5,568,771 | A | 10/1996 | Brochand | |
| 5,873,310 | A * | 2/1999 | Creissels | B61B 1/02 104/178 |
| 2009/0107357 | A1 | 4/2009 | Richard | |
| 2010/0043666 | A1 * | 2/2010 | Moritzhuber | B61B 12/022 104/180 |
| 2023/0211811 | A1 * | 7/2023 | Monteiro | B61B 10/025 104/137 |

FOREIGN PATENT DOCUMENTS

| | | | | |
|---|---|---|---|---|
| EP | 0227540 | | 12/1986 | |
| EP | 2455268 | | 5/2012 | |
| FR | 2485670 | | 12/1981 | |
| FR | 2596003 | | 3/1986 | |
| FR | 2596003 | A1 * | 9/1987 | B61B 7/045 |
| TW | 201800293 | | 1/2018 | |
| WO | 2015071573 | | 5/2015 | |
| WO | WO-2015071573 | A2 * | 5/2015 | B61B 12/122 |

OTHER PUBLICATIONS

UK IPO, Search and Examination Report under Sec. 17 and 18(3) for Application No. GB2008219.4, dated Nov. 11, 2020, 3 pages.
Uk IPO, Examination Report under Sec. 18(3) for Application No. GB2008219.4, dated Jun. 16, 2022, 2 pages.
International Search Report and Written Opinion for Application No. PCT/GB2021/051343, dated Aug. 26, 2021, 13 pages.

* cited by examiner

Fig 14a - Saw Tooth

Fig 14b - Sinusoidal

ROPEWAY TRANSPORT SYSTEM

RELATED APPLICATIONS

This application claims the benefit of co-pending international PCT Application No. PCT/GB2021/051343, filed Jun. 1, 2021, and entitled "Ropeway Transport System," which claims the benefit of Great Britain Patent Application No. 2008219.4, filed Jun. 1, 2020, and entitled "Ropeway Transport System," both of which are incorporated by reference herein in their entirety or to the fullest extent possible.

This invention relates to a new type of ropeway system incorporating a special vehicle combined with a special ropeway architecture, to offer a very flexible and high capacity transport system.

BACKGROUND OF THE INVENTION

Ropeways, usually consisting of steel wire ropes with suspended gondolas, chairs or poles, have been around for a long time, and were initially used in mountain resorts respectively as gondola lifts, chairlifts and tow lifts. More recently, the gondola system has been gaining some interest as a method for urban transport.

In a traditional ropeway, the vehicles or gondolas are supported and driven by one or more cables that form a loop between two pulleys at the ends. One of those end pulleys is driven by a motor.

The vehicles are attached to the cable, but in the modern designs can be released from the cable at the end stations to make it easy for passengers to board or exit the vehicles.

The current preferred method of attachment to the cable involves a grip resembling a pair of pliers where the jaws can be opened or closed by a lever, which keeps the jaws closed around the cable, by a set of strong springs. See, for example, patent number U.S. Pat. No. 5,568,771.

The vehicles are normally carried by the cable between the end stations, where they are released from the cable by the action of a fixed ramp or cam at the entry point to the station, which actuates a wheel at the end of the release lever on the vehicle mechanism. The vehicle, freed from the cable and moving along a track, can now be slowed down by contact with a series of motorised tires that rotate at a progressively lower speed, until it is moving at a crawling pace, where the movement of the vehicle is taken by a local chain system. Passengers can now disembark and new ones embark the vehicle in a comfortable way. The vehicle keeps crawling around the bend, after which it is accelerated again to line speed in the opposite direction, again by a set of motorised tires. At the exit of the end station a fixed ramp or cam releases the grip arm, which, under the force of the springs, grips the cable again and lifts the vehicle out of the station along its path now, on the opposite side of the cable loop, all the way to the opposite terminal station, where the process repeats itself.

A known variation is to use intermediate stations along the path. In these, the vehicles are also released from the cable and decelerated for passenger boarding, reaccelerated and reattached to the cable at the end of the station. Such intermediate stations would make sense when used in urban transport, as just two end stations, which are fine to carry skiers from the bottom to the top of a mountain, are insufficient in an urban network.

This conventional system possesses, however, some serious disadvantages, as an efficient form of urban transport.

First, all the vehicles are forced to stop at all the intermediate stations, which makes the system less efficient. Second, the process of deceleration of the vehicle, from line speed to the crawling speed of the station and subsequent acceleration to line speed, make the stations very long, even for a slow line speed. In an intermediate station this length would be twice the length of a conventional end station, the latter having both acceleration ramps side by side, on the two different arms of the loop. Such line speed (typically around 20 km/h) would be in any case probably too slow for an efficient transport network covering longer distances.

An attempt to solve the first part of the problem is made in patent US2009/0107357 by Jerome, where the stations possess a side mechanism to move the vehicles that are to stop there, out of the way, and into a local track, while allowing the vehicles that are not stopping to go through the station, unimpeded, at normal speed.

The problem does not entirely go away because, to release a vehicle and actuate a mechanism to move it out of the way, takes a considerable amount of time. This reduces the line capacity, by requiring a long headway between vehicles, to prevent a crash with the car behind on the line.

Also, as discussed earlier, the stations would still be quite long, even more complicated and thus expensive.

Patent TW201800293 describes a cable car where the suspension mechanism uses a traction system with a motor, which can slow the car down at the stations, by running backwards on the cable, allowing shorter stations. This helps with the station length, but not with the headway required to prevent a crash if the vehicle behind were to not want to stop at the station.

Ideally, the vehicles that do not need to go to the station should be deviated from its path before getting there.

Patent U.S. Pat. No. 3,871,303 shows vehicles being transferred between cables, on a track including variable speed cables, but all vehicles follow the same path and the switching is done by the track side.

Patent EP2455268 equally shows a means of transferring vehicles from the end of a loop into another, by adjusting the position of the second cable by a trackside mechanism. All vehicles also follow the same path.

SUMMARY OF THE INVENTION

According to one aspect the invention comprises a type of ropeway system having at least two cable loops that form a track, a first loop goes directly between two end stations of the track while the second loop is channelled through intermediate stations on the track or turning towers; a vehicle carried from a loop, the vehicle having a gripping mechanism on board, the gripping mechanism being capable of switching attachment of the vehicle between two or more cable loops, so as to change the loop that carries the vehicle.

The cable switching is preferably independent from the stations and also may be independent from a trackside mechanical device.

The gripping mechanism may contain a traction drive system capable of powering the vehicle along any of the cables.

The traction device may be able to tilt, where the friction wheels surrounding the cable on either side of a vertical plane passing through the cable can rotate to a position where these wheels are on either side of a substantial horizontal plane passing through the cable.

The vehicle can preferably at appropriate zones or times along the track, and according to its programmed destination, either continue to drive on the direct route cable or switch to the local cable that takes a detour to a station, or a turning tower or from a station or turning tower, to the direct route cable.

The direct route cable may be powered by the pulley at one of the end stations and the local cable may be fixed; the vehicle may use a combination of an independent cable gripper and a gripper containing a traction drive; in such an arrangement the vehicle rides the direct route cable by being suspended and pulled by the cable using the gripper mechanism; for local station operations it engages the tracking drive system along the fixed cable.

The ropeway system may comprise 3 cable loops, one taking the direct route and two passing through intermediate stations; the cable loop taking the direct route and one of the other two are driven by end pulleys; the third one is fixed; the vehicles contain an independent cable gripper and two independent traction drive systems associated with a clutch; and in such an arrangement the vehicle may move along the direct route cable by using the gripping mechanism, while station operations involve attaching the traction drives associated with a clutch to the two local cables. By selectively restricting the motion of the friction wheels around the fixed cable during a deceleration to the station or the friction wheels around the moving cable, for an acceleration out of the station, the clutch can under closed loop control, provide a precise acceleration or deceleration between the direct route cable and a station.

The direct route cable may be powered by the pulley at one of the end stations at constant speed, while the local cable loop, also powered by a pulley at one of the end stations, has a variable speed. The variable speed may be oscillating, for example constantly oscillating, between a very low value, or zero, and a high value, close to or equal to the speed of the direct route cable. The variable speed profile is preferably of the shape of a saw tooth or a sinusoid. In such arrangements the vehicle's online grippers switch the cable attachment, from the direct route cable to the local cable, while this is at its maximum speed and ride this cable to a station and release the grip at the station at a very low speed, and vice-versa, from the station to the direct route cable.

The station may be replaced by a turn tower; the vehicle would reach its slower speed at a turn, for example in the middle of the turn, and re-accelerate again to join another line in a network.

According to another aspect on the invention there is provided a ropeway vehicle possessing a suspension system containing two powered substantially horizontal slide actuators, operating in a direction perpendicular to the line of travel and in opposition to each other; each actuator slide containing an independent gripping system; and wherein each of the two gripping systems, can in its extended position, attach to one of the ropeway cables, while the vehicle is suspended by the other.

The gripping mechanism may contain a powered drive capable of powering the vehicle along the cable.

A coordinated movement of both gripping slides can transfer the vehicle's centre of gravity from under one of the cables to under the other.

Preferably using the right or left gripping system will allow a right turn or a left turn without a crash against the turning sheaves on the turn posts.

According to another aspect the invention comprises a ropeway vehicle possessing a counterweight moving on a powered slide operating in a substantial horizontal direction perpendicular to the line of travel and under closed loop control with a tilt sensor to reduce or cancel unwanted roll tilt.

According to another aspect the invention comprises a network composed of linear ropeway loops, substantially parallel to each other, and operating a certain distance from the ground, and a second set of substantially parallel ropeway loops, substantially perpendicular to the first set and operating at a different distance to the ground; and a set of substantially square or rectangular ropeway loops enclosed by the closest adjacent loops of one parallel set and by the adjacent sets of loops from the orthogonal set.

On each side of the square or rectangular loop the local cable may lie close to the main line cable at the standard distance set by the sheaves in the posts that guide both cables along the main line on that side of the loop. The cable on the sides of the square loops are then raised or lowered to the height of the turning towers or the stations, on the ground, or at a set height above ground.

A ropeway system or network according to any aspect of the invention may comprise a vehicle according to any aspect of the invention.

The system/vehicle may transport passengers or goods or both.

According to another aspect of the invention a method of travelling from station A to station D comprises using a gondola suspended from a first cable extending from station A to station B for part of the journey and changing the cable from which the gondola is suspended to be a second, different, cable extending from point C to station D, point C being a point where the first and second cables come in close enough proximity for a second cable gripper mechanism of the gondola to grip the second cable before a first cable gripper mechanism of the gondola releases the first cable, thereby transferring the gondola from the first to the second cable in a transfer operation.

Preferably the transfer operation occurs away from a station. The transfer operation may occur at a point and time when the first and second cable are moving at substantially the same speed. The transfer operation may be such that when the first cable is moving and the second cable is stationary, the second cable gripper mechanism has a motive force gripping mechanism that is running at a speed so as to achieve a gondola speed on the second cable that is substantially the speed of the first cable.

The prior art does not show a switching method to send vehicles into more than one destination. Additionally, track-side mechanical switching is problematic for suspended vehicles as these are in the air, but more importantly because if a short headway (narrow separation between vehicles is used at high speed), there is very little time to switch a track mechanism to independently send different vehicles following each other into different destinations.

BRIEF DESCRIPTION OF THE DRAWINGS

The attached drawings show, solely by way of example, various embodiments of the invention, in which.

BRIEF DESCRIPTION OF THE PREFERRED EMBODIMENTS

Figure 1:
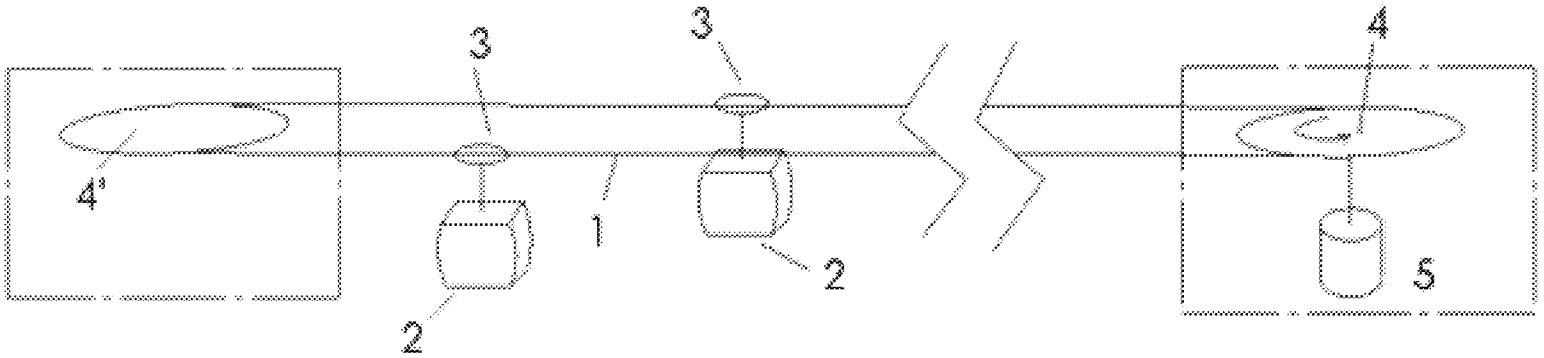
Prior art Fig 1
FIG. 1 shows a general perspective of the prior art conventional ropeway track

FIG. 1 shows a conventional gondola lift, with detachable vehicles running on an endless loop 1, normally a steel cable, being supported by two pulleys 4 and 4' at the end stations, and support posts with free running sheaves along the track (not shown) with a pulley at one of the end stations, 4, being driven by motor system 5.

Figure 2:
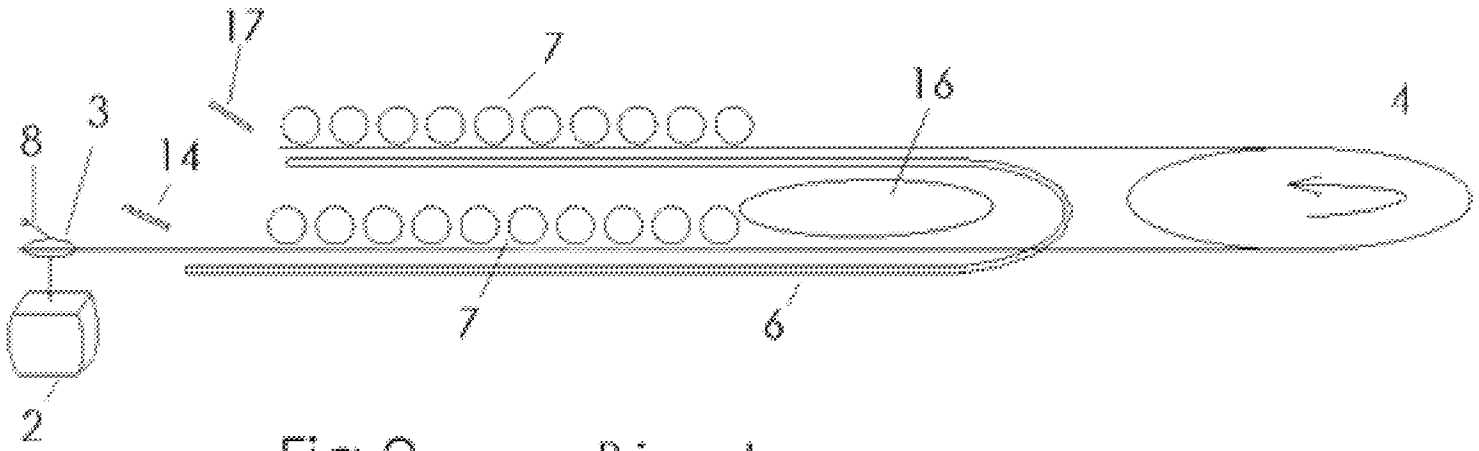
Fig 2 Prior art
FIG. 2 shows the prior art end stations arrangements

FIG. 2 and FIG. 3 show a known mechanism at the end stations, where the sequence of events involved in conventional stations will now be described.

Vehicle 2 arriving at an end station is detached from the cable by cam 14 acting on wheel 9 part of lever 8 of the suspension gripping mechanism 3.

Figure 3A:
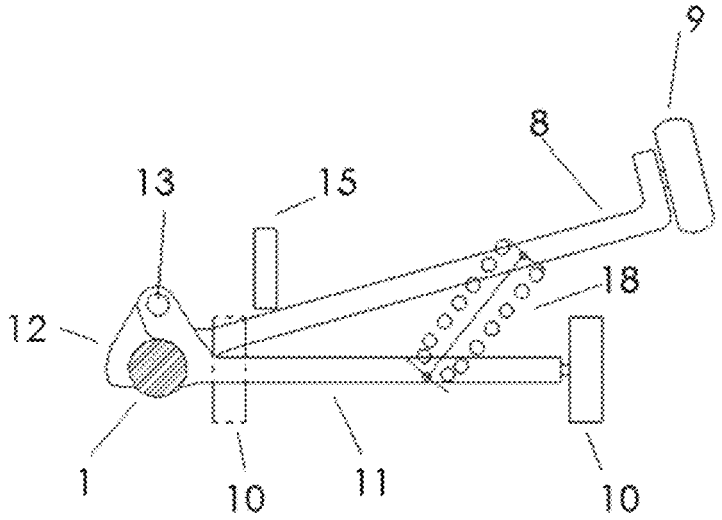
Fig 3a Prior art
FIG. 3*a* shows a side elevation of the prior art cable gripping mechanism
Figure 3B:
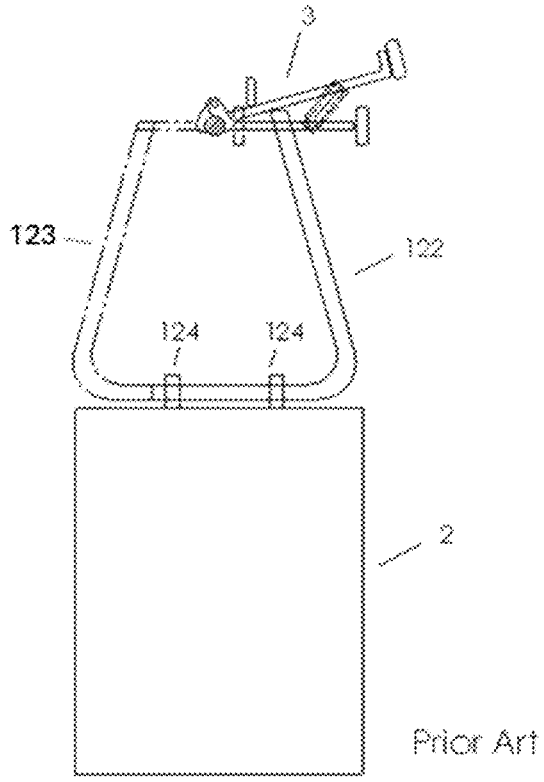
Fig 3b Prior Art
FIG. 3*b* shows a front elevation of the vehicle suspended by the hanger

FIG. 2 and FIG. 3*a* also show a schematic of a known gripping mechanism where wheel 9 at the end of the arm 8 is part of the moving jaw 12 pivoting at bush 13. As it is pressed down by cam 14, it releases the cable 1, in a similar way to a pair of long arm pliers. The vehicle is then decelerated from the line speed, through contact between driven tires 7 with platform 15, on top of mechanism 3. Each tire has a progressively lower speed which slows down the now freed vehicle from the cable riding on track 6 using wheelset 10 part of the gripping mechanism. At the end of the powered tires sequence, mechanism 3, and thus the hanging vehicle, is moved by a slow chain 16, and performs a slow 180 degrees turn allowing the passengers to disembark and new ones to embark in the vehicle. At the end of the chain, the suspension gripping mechanism is again accelerated by a sequence of tires to reach line speed in the opposite direction. At the exit point to the station, cam 17 acting again on the gripping mechanism's wheel 9 re-grips the cable. The gripping force on the cable is controlled by springs 18.

As can be deduced from the previous description, this system works well for a track with two end stations. It does not work well if intermediate stations are present. Here there are two problems. Either all vehicles stop in all stations, which is a very slow and inefficient, or a very large gap is required between the vehicles, so the vehicles that stop in a station are removed out of the way. In the later design the transportation capacity of the system is severely reduced.

We will now look at how this problem is solved with the present invention.

In one of the embodiments, involving a linear track, the two loops are being held between the two end stations. The first loop going directly between those end stations, while the second loop is channelled between the intermediate stations on the track, FIG. 4.

Because there are two cables, one being a direct line and the second a local line, it is possible for the vehicle to either continue on the main cable or switch to the local cable before the station detour. That means all the stations are off the main line and any vehicles going to that station way will not delay the vehicles on the main line, by the slowing down that will happen at the station. Let's look in more detail.

Figure 5:
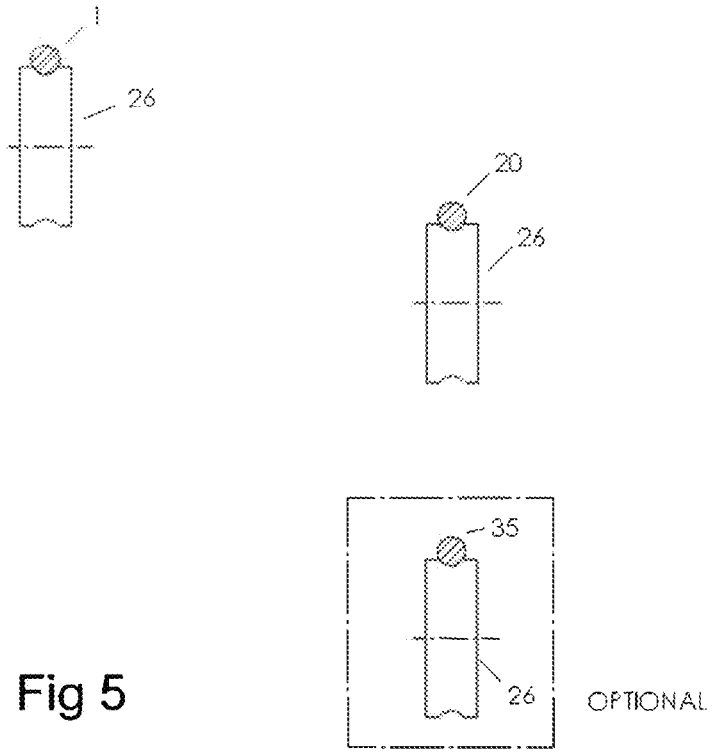
FIG. 5 shows a simplified section of two or three cable loops on one side of the endless band being supported by the cable support sheaves

Pulleys 4 and 18, present at one of the end stations, support the cable loops 1 and 20, here shown only on one side of the band. These cables are then supported along the track by posts 22 having hanging mechanisms 21 containing support sheaves 26. FIG. 5, shows a cross-section of the cable arrangement using a single sheave per cable for simplicity. Upon reaching an intermediate station down the track, 27, the direct cable loop continues between posts 23 and 28, supported by the hanging sheaves set 21. The local cable loop 20 is diverted down into the ground by secondary hanging sheaves sets 29 and 30, on each side of the station supported by posts 23, 24 and 28. This mechanism contains sheaves 26 supporting cable and 20, with a separation, in this case on two vertical planes as shown in FIG. 5. In station 27, the vehicles are suspended at ground level, possibly with the aid of a linear track, for ease of access, including wheel chair users. The cable curvature at 29 and 30 allows a large angular slope of cable 20 near the ground stations, and thus a potential very short station, due to almost immediate ground clearance before and after the station. This is important in urban environments, which have many potential obstacles and where land is expensive.

Figure 6:
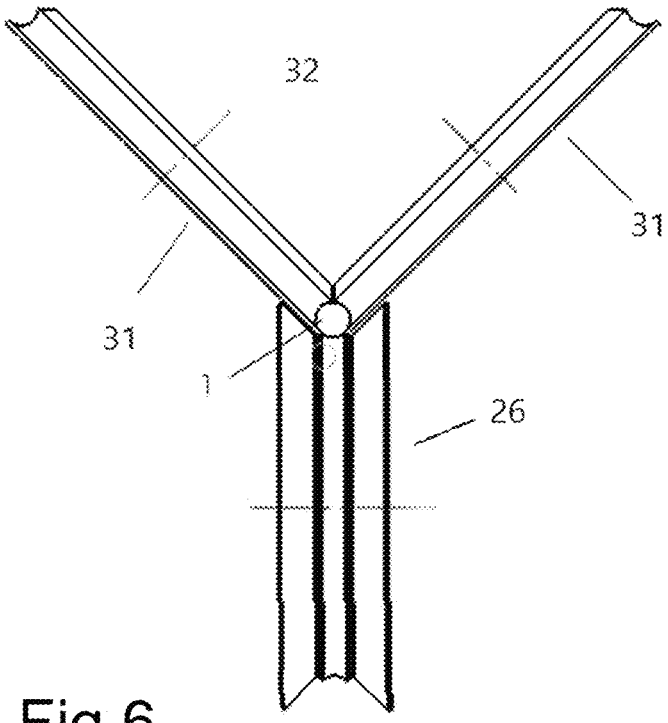
FIG. 6 shows an arrangement of pressure wheels that can pass through special cable support sheaves according to the invention

Different embodiments of the invention will use, either, powered moving cables and a set of grippers similar to that shown in FIG. 3, or fixed cables and a set of powered pressure wheels 31 enclosing the cables, FIG. 6. In this later case the pressure wheels will have a profile, in combination with the sheaves, to allow the vehicle to ride over them without derailment.

Figure 7:
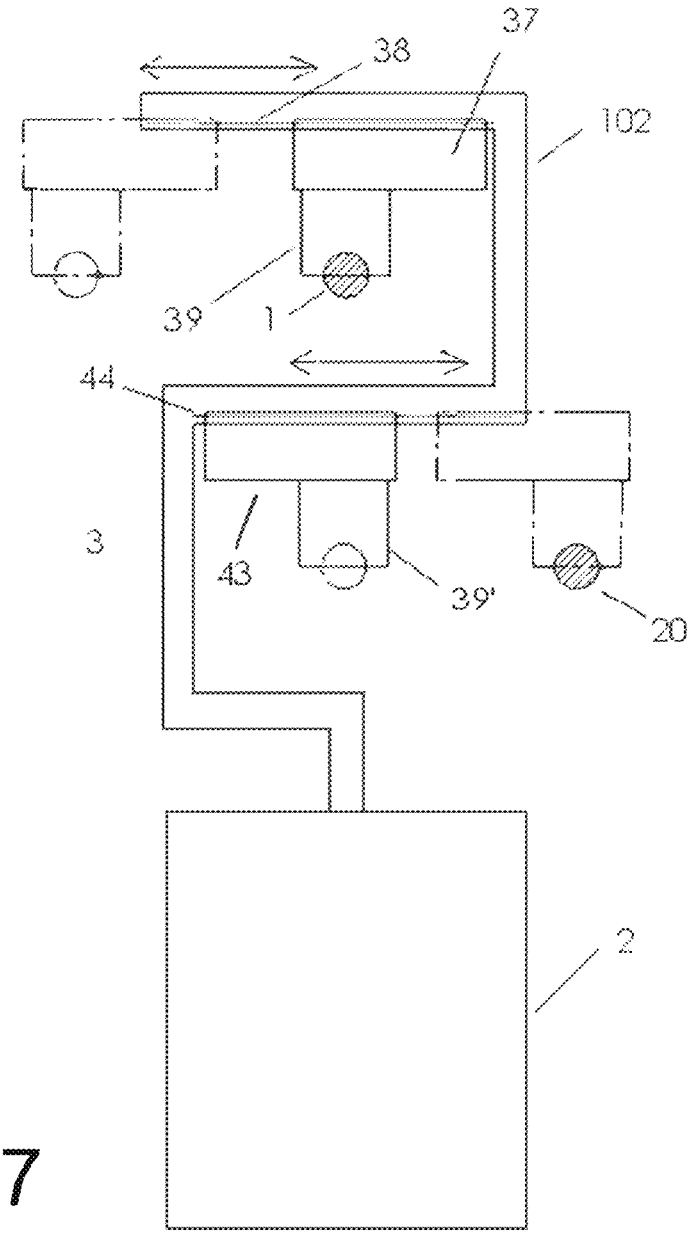
FIG. 7 shows a view of the vehicle mechanism perpendicular to the support cables

Regardless of the propulsion method, the vehicle will have a suspension mechanism 3 for the gondola 2, like that shown in FIG. 7.

The special frame, 101, possesses two stacked horizontal slides 38 and 44, allowing open side access to cables 1 and 20, on the opposite sides of the mechanism. The vehicle, can attach itself to either cable, and follow that cable closely, and away from the opposite cable, without being trapped by the opposite cable.

For each of the cables, there is a gripping system, 37 and 43, that move laterally on the slides 38 and 44. The gripping system contains an element 39, which, depending on the embodiment of the invention, is either a set of jaws to grab the cable like those in FIG. 3*a*, or a set of powered pressure wheels 32 like those in FIG. 6.

Figure 8:
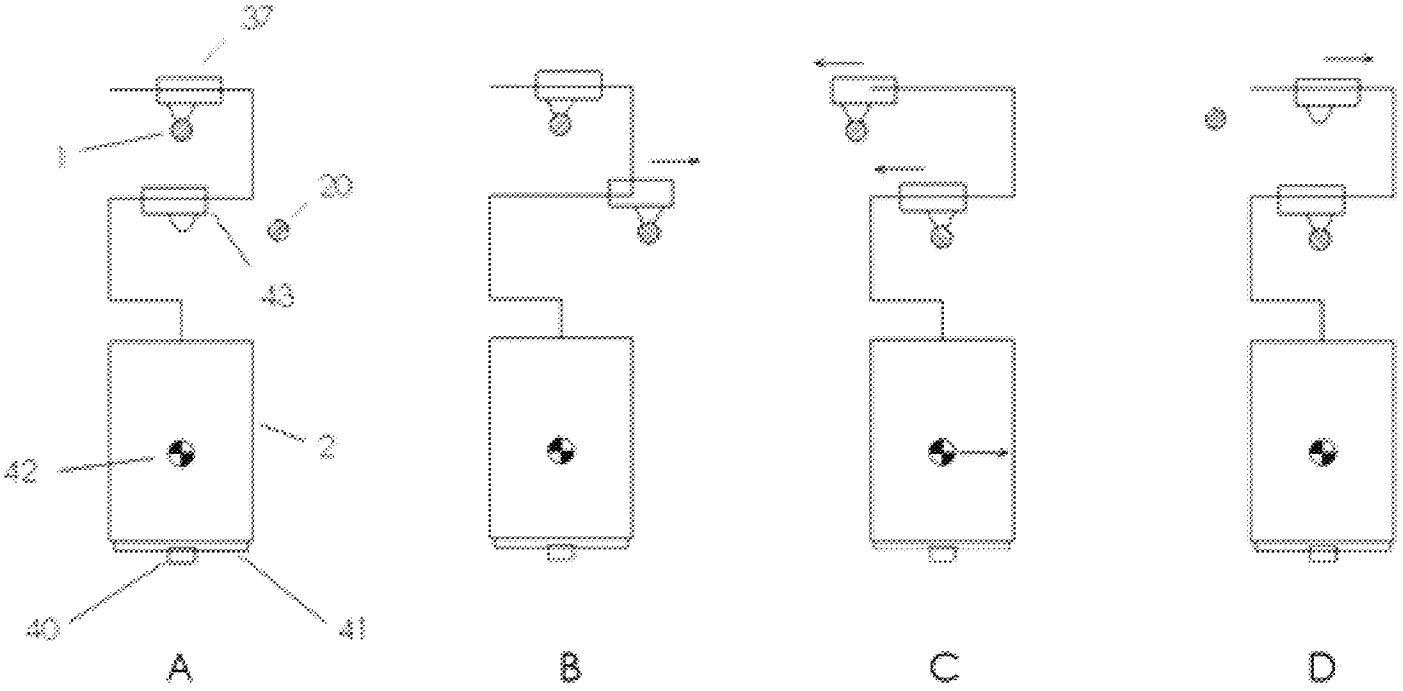
FIG. 8 shows the sequence to perform a cable switch

FIG. 8 shows the switching sequence between cables. In FIG. 8*a*, vehicle 2, suspended on mechanism 3 is riding cable 1 using gripping system 37. The centre of gravity of the vehicle, 42, lies naturally under cable 1. To switch to the local cable 20, for example to go to the next station, gripper 43 is moved to the right on slide 44 and attaches itself to the cable using device 39, FIG. 8*b*. In the next step, both grippers 37 and 43 move at the same time, and speed, to the left on slides respectively 38 and 44, FIG. 8 *c*. This will shift the gondola's centre of gravity to lie under cable 20. In the final step, gripper 37 is simply disengaged from cable 1 and moved back to its neutral position on slide 38. Note that the release of cable 1 can only be performed after verification that cable 20 is already successfully gripped. This could be done, for example, during step c, where different procedures involving, for example, the motor currents that drive both slides can be monitored.

When device 39 is a set of driving wheels, one of the driving motors can work as a generator, for example, and thus verify the grip of both devices. We will not dwell on this, as different processes to verify a successful grip will be easy to imagine for an engineer in charge of such task.

There is an optional device present in the vehicle. That is counterweight 40, which is actively driven on slide 41, in under closed loop control using a tilt sensor and a motor.

This counterweight can be used to tilt the vehicle around it pivoting point, the suspension cable. This could be necessary to level the vehicle, and thus, mechanism 3 so that for example, when gripper 43 moves on its slide 44, it easily finds cable 20. The unwanted tilt, that needs cancelling, could have been caused by an uneven distribution of the passengers in the gondola 2, or caused by cross wind, for example.

The cancellation of tilt, caused by cross wind, is, by itself important, allowing the operation of the vehicle at higher wind speeds, even while suspended on a single cable.

Patent EP0227540 shows a gondola supported by two grippers that attach themselves to a conventional dual cable system. The centre of gravity of the vehicle is always in between and in the middle of the two suspension cables, where both have to be always attached, when the vehicle is moving. The grippers are at the end of two arms that either pivot in the longitudinal plane of the track or on a plane perpendicular to this, in order to release the cables. This is so that the vehicle can be released at the end stations. Due to the existence of two cables, and thus two suspension hangers, the movement of the vehicle in a track 6, FIG. 2, after the grip release, will always leave one of the hangers trapped by the cables and unable to follow the round track. The pivots move these two hangers out of the way completely, so the vehicle can follow the track 6, like a vehicle with a single hanger.

The present invention, as described in FIG. 7, possesses not only two attachable grips to two independent cables, but these are ridding two independent slides. The slides move the grippers and the gondola sideways and are able to attach and detach, and thus transfer the vehicle from one cable to another, where the centre of gravity of the vehicle is transferred from under one cable to under the other cable.

Figure 9B:
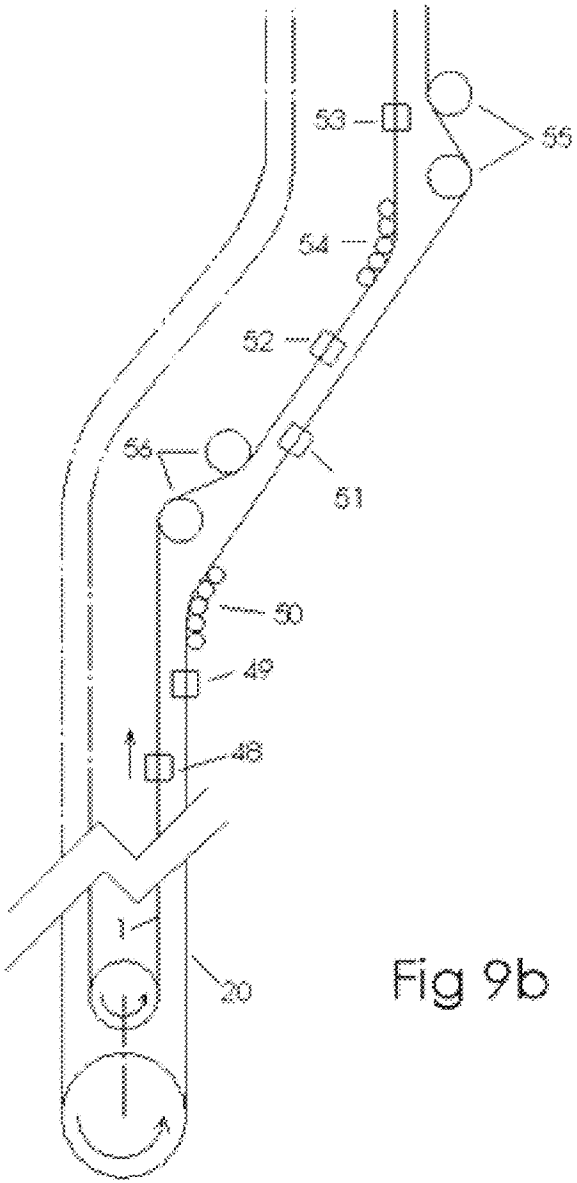
FIG. 9*a* shows the impossibility of turns on a conventional system and FIG. 9*b* shows a track with both right and left turns for the special vehicle

The importance of this detachment, according to the invention, is, in addition to being able to switch between the main line and the station detour that we discussed before but also to be able to perform left and right handed turns. See FIG. 9.

FIG. 9 shows, in some detail, the issues of turns in a track.

Figure 9A:
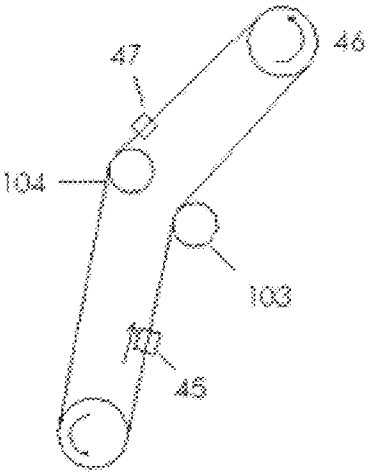

Conventionally, as can be seen in FIG. 9*a*, turns are not possible. This is because, the vehicle has to always lie on the outside of the curve. A wheel or set of sheaves always lies on the opposite side, forcing the cable to bend. A conventional gondola is hanging from the grip around and over the cable, see FIG. 3*b*. The hanger 122, that suspends the gondola, is then lowered either on the inside or the outside of the cable loop, positions respectively 123 or 122. In other words, to the left or the right side of the cable. It is then attached to the gondola by supports 124. The grip cannot, of course, be under the cable as, this is where the sheaves are, holding the cable itself, FIG. 6. When the vehicle reaches the end station, it will have to be replaced on the same side of the cable where it came from. So, if vehicle 45 had the hanger in position 123 (the obvious way, when the bypass track is inside the main pulley), it would be able to perform turn 43. The extra bulge from the grip around the cable does cause a slight set of vibration in the sheaves, while passing them, but the grip successfully continues holding the cable and brings the vehicle all the way to the end station 46. There, it would be removed from the cable and reattached on the inside of the cable loop, like we have seen in FIG. 2. On its return journey, it would then crash hanger 123 against the sheaves at turn 44, and cause a derailment.

So, a conventional gondola, cannot follow such a track, or in other words, perform any turn in a return track, because the outside of a turn is, of course, the inside of the opposite turn. Therefore only turns in one of the directions, on one side of the loop are possible, a very limiting feature.

The conventional solution to this huge problem, is to use a turn station. These stations, transfer the vehicles from one loop to another loop, using an external track similar to that of the end stations. All the vehicles have thus to be decelerated, detached, channelled through a track, re-accelerated and attached to the new loop. The new loop can be at any angle to the first loop. As can be imagined, this is a very expensive way to perform a turn, the reason why it is rarely used. It can also be used to extend a loop. For example, see patent U.S. Ser. No. 00/517,2640.

According to the invention turns to both sides on a loop are now possible. Let's see how this works in detail with an example of a right and left turn, FIG. 9*b*.

A vehicle in position 48 is attached to the main cable 1 on the right side of a track. In order to follow the track, on the upcoming right turn, if switches to cable 20 at position 49. By using the gripper system, that now holds cable 20 on its right, the vehicle will be able to move along set of sheaves 50, as the jaws pass through the rubber lined sheaves. These hold the cable and force a smooth, large radius curve until the vehicle emerges in position 51. Wheels 56, keep cable 1 out of the way of the vehicle suspension, but so that it will re-join a parallel track to cable 20, at the standard separation after the curve. Now, a turn to the left appears on the track. The right hanger holding cable 20 would crash against the wheels 55. Therefore, another cable switch is performed, where the gripping mechanism switches to cable 1 at position 52. The vehicle will successfully pass the curve to the left 54, and come out at position 53. Wheels sets 50 and 56 as well as 54 and 55 can all be mounted in two turn posts. It is thus possible to turn left or right along a track without the extra delay and cost of having to remove the vehicles from the cable loop and re-inserting them on another cable pool. Such system is now much more practical in an urban environment, which requires plenty of turns.

The invention is however not limited to linear tracks. Because the vehicle can efficiently change between cables, it can, like an automobile on a road system, move from A to B in order to get to the destination. It is free to roam.

Let's see this in more detail.

Figure 10A:
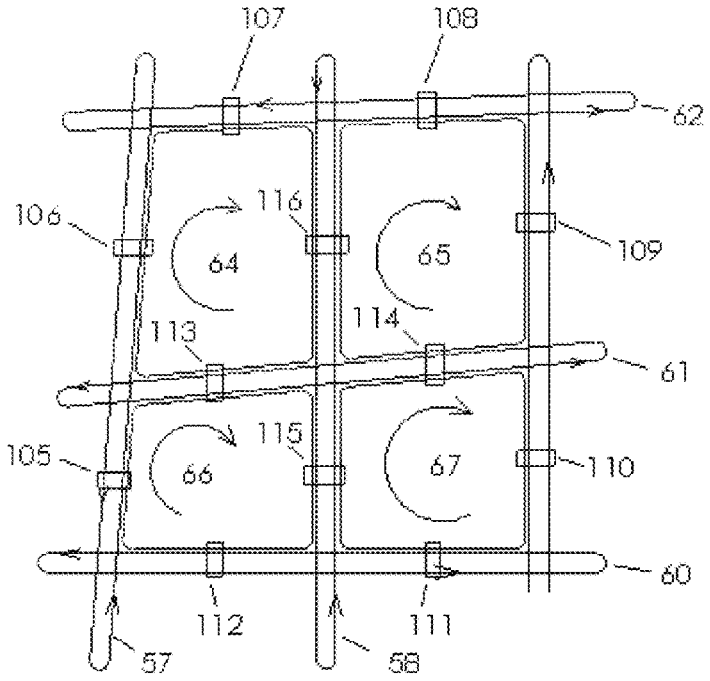
FIGS. 10*a* and 10*b* show two possible implementations of a two dimensional network covering a large area

FIG. 10*a* will now show how a large urban area can be covered by the system. Cable loops 57 to 62 are linear tracks of the type described before, and contain a direct cable loop 1 as before. There is however, not a single local cable 20 fed though the whole track, like that shown in FIG. 3. Instead, the posts along the track contain the possibility of carrying a local cable, but this local cable is the side of square loops 63, 64, 65 and 66. As will be explained later, these local loops will allow the transfer of a vehicle between the different tracks, and thus the full freedom of circulation mentioned. Loops 57, 58 and 59 are, for example, laid out in a general north-south direction, while loops 60, 61 and 62 are in an east-west direction. To avoid collisions, the north-south loops are held at a different height above the ground to the east-west loops. That way, vehicles circulating in the system, can remain in a track and cross over all the perpendicular tracks without any hindrance, or need to stop and wait. The approximate square grid shown in FIGS. 10*a* and 10*b* would have a pitch between the loops of the order of 800 metres to 1000 metres. This is because, stations 105 to 116 can be located in the middle of each of the 4 sides of the loops, providing a maximum walking distance well below 400 m-500 m in the case of the network in FIG. 10*a*, a practical consideration.

In areas of greater demand for transport, like a city centre, it is both possible and desirable to reduce the pitch size of the grid, in order to increase the system capacity, and reduce the average walking distance to the nearest station. The pitch can be increased towards the periphery of an urban area, into its suburbs. Here, it would be possible to use only certain loops, going to strategic locations, in order to match demand and supply while keeping the network costs down.

Figure 10B:
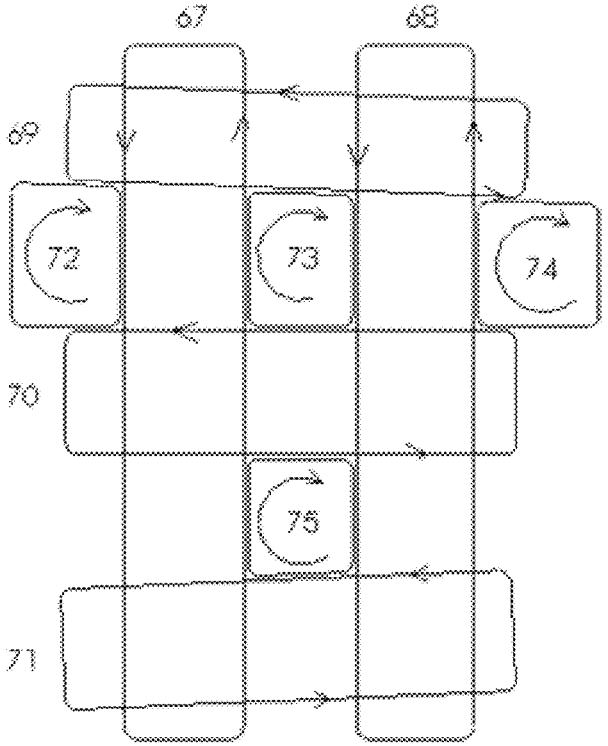

FIG. 10*b* shows a different variant of the network shown in FIG. 10*a*, where the cable loops are now opened widely, to make a one way track system. The loops are not now carried by a line of posts, like in a conventional cable car. In this arrangement there are less cables and also less possible turning loops, as only half the turning loops are possible, at for example positions 72 to 75. In the other positions, a vehicle traveling along a local loop, would not be able to mix, and thus exchange with traffic coming along the main lines as the direction of traffic would not be the same in both.

Figure 4:
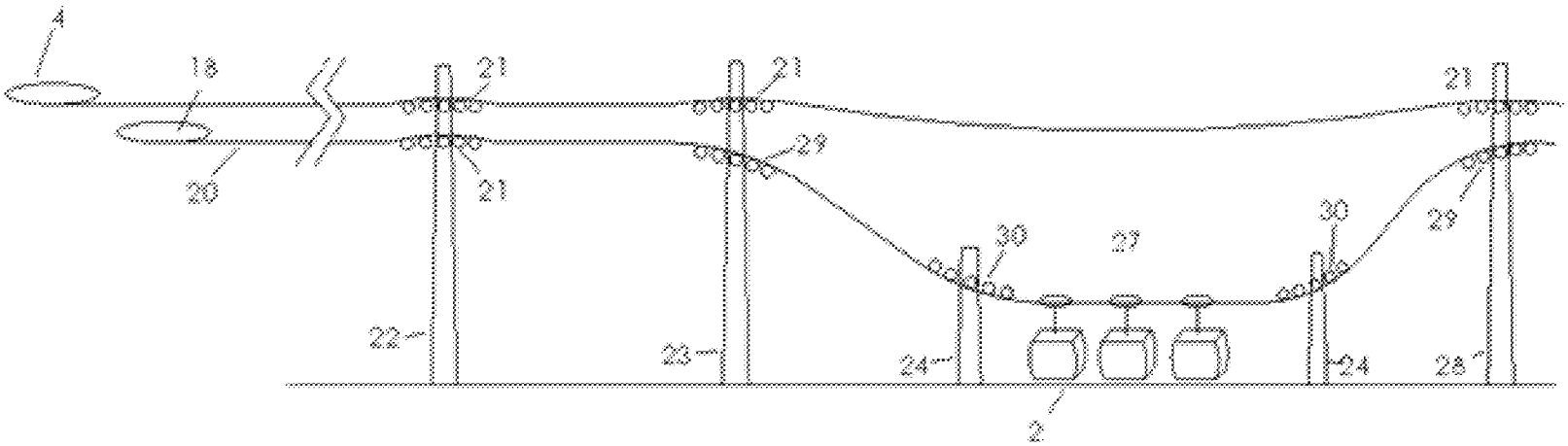
FIG. 4 shows the architecture of a liner track according to the invention
Figure 11:
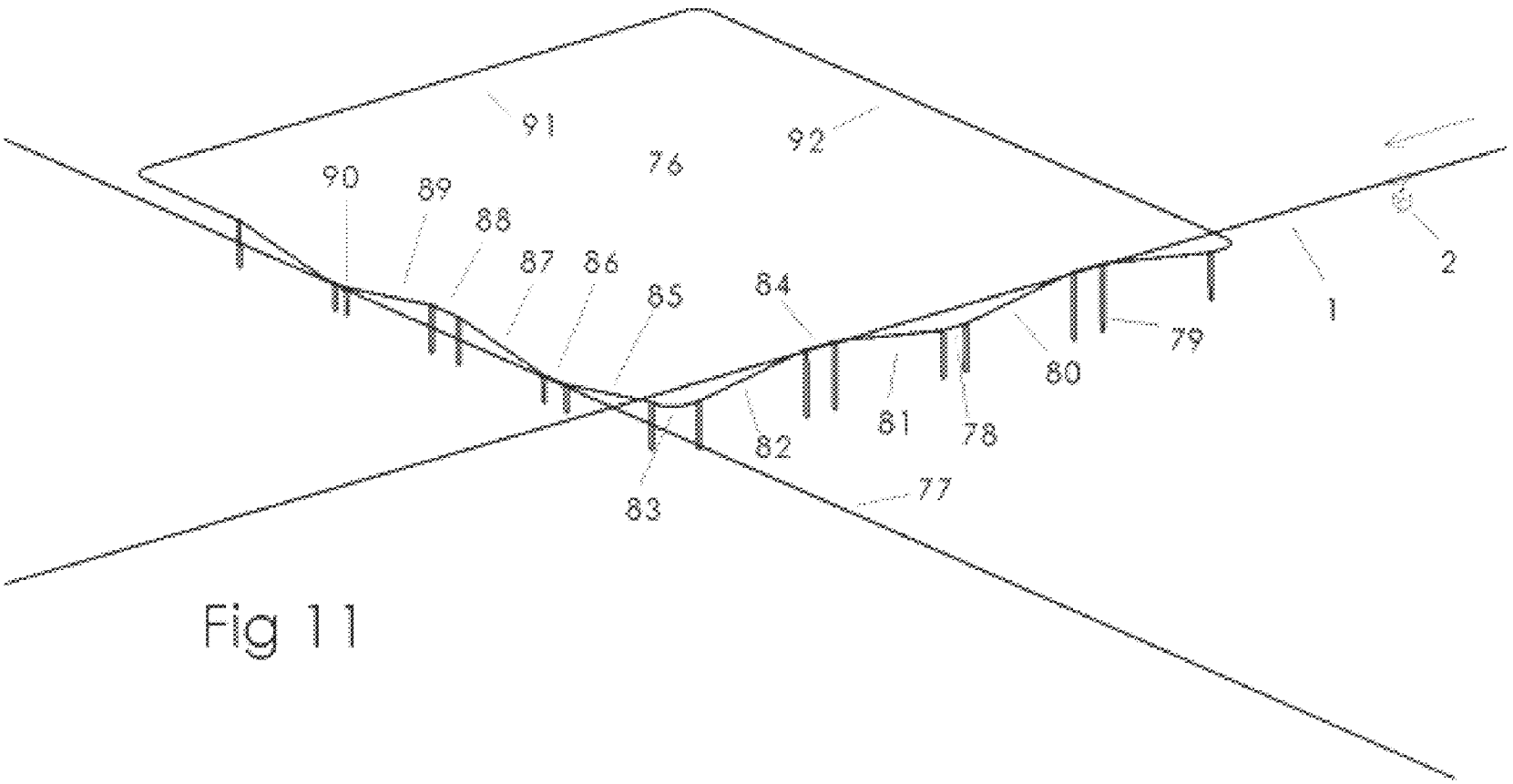
FIG. 11 shows the detail of the line transition in one of the loops of FIG. 10

Let's now look at the details of the vehicle transfer between the north-south and east-west lines of the grid. In FIG. 11, vehicle 2 is moving along cable 1 to the left of the figure. As an example, let's assume the vehicle in cable 1 is moving in a westward direction at 14 metres above the ground. If it does not want to turn, it will remain on cable 1 and cross over cable 77 from another loop laid out in the north-south direction. There is no problem of interference, as cable 77 is in the same example, at 8 metres above the ground. If vehicle 2 wants to stop, at say, stop 78, it will transfer to the square loop which will appear side by side, at the standard position to the main cable 1 between posts 79. The distance between such posts could typically be between 100 to 300 metres, so there is enough time for such transfer. The vehicle will now follow line 80 and stop at 78. This could be a slightly elevated station, or it could lay on the ground, as seen in FIG. 4. Any passengers joining at 78 will exit the station through cable loop segment 81, and can transfer to the main cable at 84. Alternatively, the vehicle from the station 78 or any vehicle on the main cable 1, can during section 84 remain or transfer to the local loop and go down the slope 82 to turn 83. The descent will continue at 85, until cable overlap zone 86 is reached. Here the vehicle can transfer to cable 77, or remain in the local loop to reach elevated station 88. The vehicle can even potentially transfer to other lines adjacent to sides 91 and 92 of this local loop. Turns like that at 83 can be achieved through a set of sheaves, like those in FIG. 9*b*, in order to perform a large radius smooth curve.

An important point is that if the separation between vehicles is short (small headway), a vehicle leaving the main cable 1, for example at 80, will be extracted vertically from a line of vehicles, and will only decelerate after there is no longer any interference with the vehicles circulating behind and now above it. This way, all vehicles will maintain their top speeds on the main lines, be them self-driven or pulled by the cables and no waiting is required at any intersections or junctions. A vehicle will move from the initial station to the final destination at full speed, only slowing down at the final station or at an intermediate turn, like turn 83, performed at mid-height, in our example, 11 metres above the ground.

Figure 12:
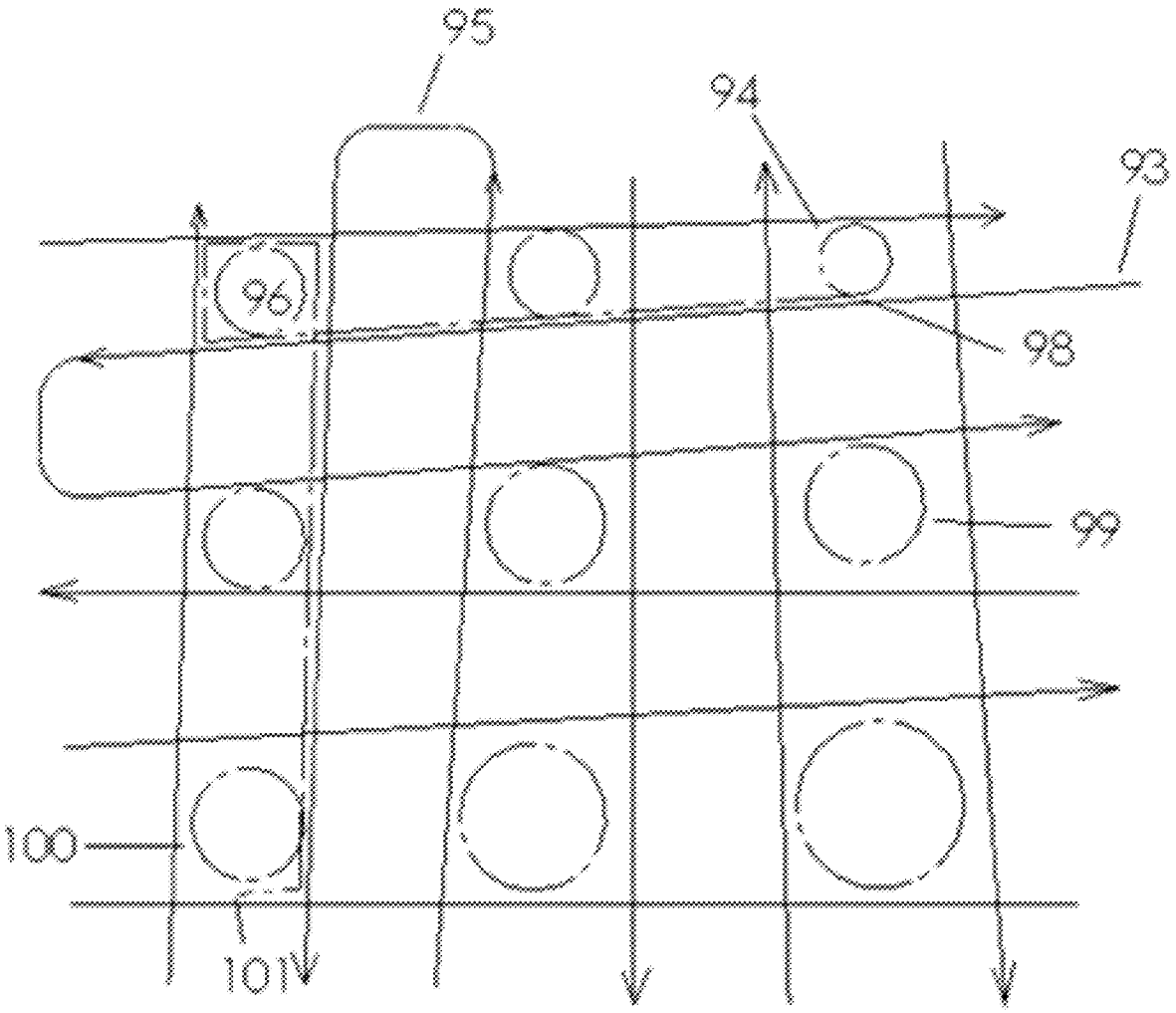
FIG. 12 shows an example of the trajectory of a vehicle along a network

FIG. 12 shows a typical travel sequence. In this network, all the linear cable loops work in an anti-clockwise direction, while the local loops work clockwise. A passenger can pick up a vehicle at station 98, move along main line 93 westwards, and pick up loop 96 to connect to the southward direction in loop 95. It will leave loop 95 on local loop 100, which will deposit the vehicle at its destination, station 101, in the middle of the south side of loop 100.

A completely automated transport system can thus be built, for an urban area, by the use of a well-chosen set of main lines and local loops.

The advantages of the invention relative to conventional modes of transport are, the very high system capacity due to a high number of vehicles that can pass in a track per unit of time, allied to the non-existence of intersections with their associated delays. Unlike a bus, tram, or underground system, the passengers will also only stop at their final destination, not in all the intermediate stops. This will increase the system efficiency enormously. The system is of course completely automated with a very high degree of safety as it operates like a dedicated machine which is segregated from the ground level where pedestrians, cyclists, animals, etc. are present. There is no need for parking, as the vehicles will continue on the network after delivering a set of passengers and will move on demand to the next call. And, of course, no driving licenses are required. The system operated at full speed as the central computer will have booked all the intersections before the vehicle gets there. Congestion is thus not possible. Lastly, the system runs 100% on electricity, therefore pollution or CO2 emissions are not present.

As mentioned, the movement of the vehicles in these loops involves a synchronous control operation, with pre-booked "flight plans" from a central computer. This ensures that all the intersections are free at the exact moment the vehicles need them. This will involve using a system of moving "slots" which are possible positions for a vehicle all over the network and moving at the network speed. The slots can be occupied by a vehicle or be empty and thus able to receive a vehicle, for example from a station.

Let's now look at the different ways to provide propulsion to the vehicles.

In an embodiment of the invention, both the direct cable 1 and the local cable 20 are fixed. Pulleys 4 and 18 (FIG. 4) are simply an anchoring system for the cable. However, the use of the pulleys could still be useful for the initial launch of the cable, or when this is being replaced. Additionally, a slow crawl of the cable, can be used, when pulleys are present, to spread points of high cable wear throughout the whole cable loop. This will significantly increase the life of such cable.

The suspension system 3 of every vehicle, will contain at least two independent drive systems containing pressure wheel set 32, FIG. 6. Pressure wheels 31 partially enclose and clamp the cable, while, at the same time, allowing the vehicle to pass through the cable support sheaves 26, at the support posts throughout the track. These wheels, will have to tilt to a substantially horizontal position to oppose the sheaves, during a turn. At cable suspension system 30, the conventional set of sheaves, on the upper side of the cable, would have to be replaced with a more complex arrangement involving thin clamps that hug the cable to prevent a clash with the friction wheels. The clamping force between the friction wheels and the cable will be maintained, for example, by a spring set.

A vehicle intended for the local station, FIG. 4, and running along cable 1, using a first drive system at 39, (FIG. 7) would engage a second drive system to clamp cable 20, between posts 22 and 23. After verifying such clamping, it would disengage the initial first drive from cable 1. The vehicle, would thus pull itself along cable 20 all the way to the station 27 at ground level, and slow down by its own means, to disembark and embark new passengers.

If the vehicle was not intended for that local station, it would simply keep riding cable 1 at speed towards its destination. A pantograph of the type used by electric trains or trams can be used, for example, to tap electrical power between cables 1 and 20 if these were at different voltages, one being a live wire, the other a neutral and ground return wire, thus powering the vehicle along the direct line. The local line operation can be performed on battery power, which could be charged, either at the station or during the ride in the direct cable or both. A third electrical cable, parallel to the other two along the main track, could also be used for power.

The advantages of this embodiment are that the speed of the vehicles can be very high, while on the mainline while at the same time they can decelerate for example to reach the local stations, or to perform a turn. Because the vehicles are not attached to a driving cable, all these speeds can be modulated for optimum efficiency. The second advantage is the stations, can now be very simple and short, as a deceleration and acceleration regions are no longer required. The price to pay is a higher complexity and cost as the vehicles are now self-driven.

In different embodiment of the invention, simplicity and reliability is placed above all. Here the vehicles are hauled by the cables driven by the pulleys 4 and 18, at one of the end stations. Both the direct cable loop and the local loop are driven at the same speed. The gripping systems 37 and 43, in each vehicle, instead of having a driving system at 39, simply have a set of independent grips with jaws. Thus, a vehicle moving along the track suspended and pulled by cable 1 through grip 37, FIG. 7, could change to a suspension by grip 43 before post 23 (FIG. 4) and thus arrive at station 27. These grips would be able to actuate independently of the station, while the vehicle is riding the main track. The grip holding the local cable would still have to be disengaged at the beginning of station 27, either by a cam 14 as discussed or independently, using its own mechanism. Arm 8 and wheel 9, FIG. 3, are ideally still present to override the independent mechanism if this failed. Thus a vehicle appearing at speed at the entrance to a station is successfully disengaged from the cable, in all cases. The station, however, would still require means of decelerating and accelerating the vehicles, respectively arriving and leaving the station by, for example, the set of tires 7 shown in FIG. 2.

Independent grippers at 37 and 43 can be driven electrically, hydraulically or pneumatically, for example. The power would be provided by a battery charged at the stations.

The advantage of this design is the extreme simplicity of the vehicles. These are almost passive, and simply ride the cables, but are able to make a switch between cables at the strategic points in the network. This system maintains the freedom to operate in the whole network, like before but without the requirements for a drive system, or the power requirements to feed such a drive. The great simplicity will very likely bring great reliability of operation. The cost is longer middle stations, which require the acceleration and deceleration zones.

In a different embodiment of the invention, a combination of the two previous embodiments is present. The direct route cable is powered like in the previous embodiment, but the local cable is fixed. The vehicle then uses a combination of an independent gripper 37 with jaws, but also a drive system with friction wheels 32 at position 39, on gripper 43. The vehicle rides the direct route cable 1, by being suspended and pulled by the cable, using the gripper mechanism 37. For local station operations it would engage a drive system 39, containing friction wheels 31 into the local cable, and ride the cable in and out of the station.

The advantage of this embodiment in relation to the previous embodiment, is that the station would be shorter and simpler, as the deceleration and acceleration tires would no longer be required. The power to run the motor drive could be provided by a battery, charged at the station or during the ride on the main track from a pantograph. It retains the performance of the self-driven vehicle but without the high power drive and power requirements for propulsion along the main line. A secondary propulsion system for the local cable is however still a requirement. This embodiment is thus a compromise between the two previous designs.

In another embodiment of the invention, there are 3 cable loops, one taking the direct route and two passing through the intermediate station. The cable loop taking the direct route and one of the other two are driven by the end pulleys. The third one is fixed.

The vehicles are semi-passive and the vehicle grips and rides the direct route cable. Station operations, involve a set of drives, connecting with the two local cables, with the actuators involving two sets of partly opposing pressure wheels sets 32 and a clutch.

The vehicle will then make use the clutch, possibly of a viscous or friction operation, or the electrical equivalent, to allow more wheel speed in either the fast moving cable wheel set or the fixed cable wheel set. This will allow, under closed loop control, a precise deceleration to a station up to a standstill or an equally precise acceleration from a station to the direct cable.

Figure 13:
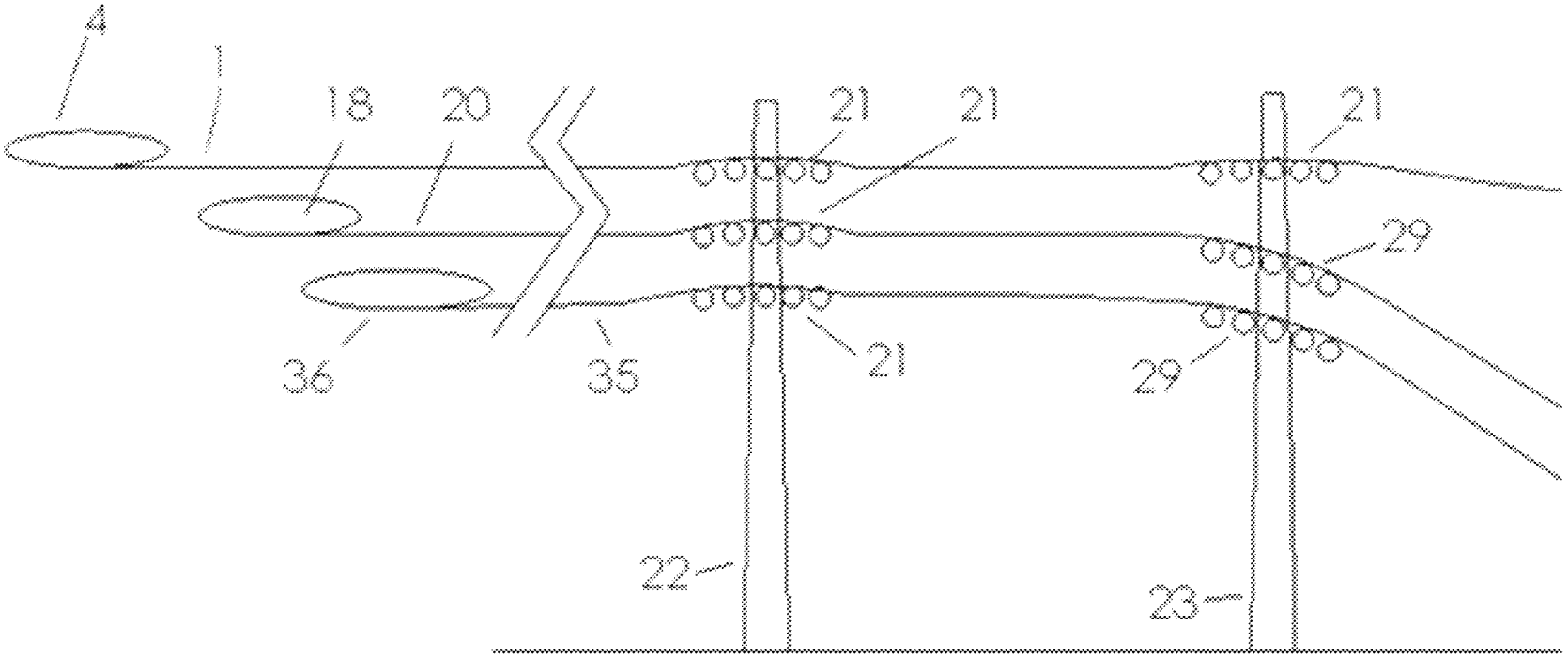
FIG. 13 shows a side elevation of a track with three cable loops

For example, a vehicle going to the station 27 would now engage cables 20 and 35 after post 22 and before post 23 while releasing cable 1, FIG. 13. On the way to the station, cable 35 would be allowed to turn the wheels of its drive unit at great speed while the drive unit gripping cable 20 would turn very slowly as the vehicle is still close to the speed of the direct line cable. As the vehicle is decelerated to the station the wheels on the drive around cable 20 would start spinning faster while those on cable 35 would start turning slower in inverse proportion. The control of such rotation performed through a viscous clutch employing, for example, automatic transmission fluid and a system similar to the torque converter in a car automatic transmissions, will, under the control of a microprocessor, produce a precise deceleration to the station.

The power for the acceleration comes from the fast moving local cable, and the power from the deceleration can simply be dissipated as heat inside the clutch. The suspension mechanism does require just a small amount of power for control purposes and grip actuation, probably coming from a battery.

In the above embodiment of the invention, the vehicle does not require high power drives or high power supplies. The energy for the accelerations and decelerations are provided by the two local cables. The system depends on the clutch system to be able to balance how much energy to extract or dissipate. A compact and reliable clutch system will provide a high performance operation with short and simple stations. This can be a potentially better system when the clutch can be made cheaper and more reliable than the self-powered drive system.

In another embodiment of the invention, two cable loops are used like in FIG. 4, where cable 1 takes the direct route while cable 20 goes through the intermediate station or stations.

Figure 14:
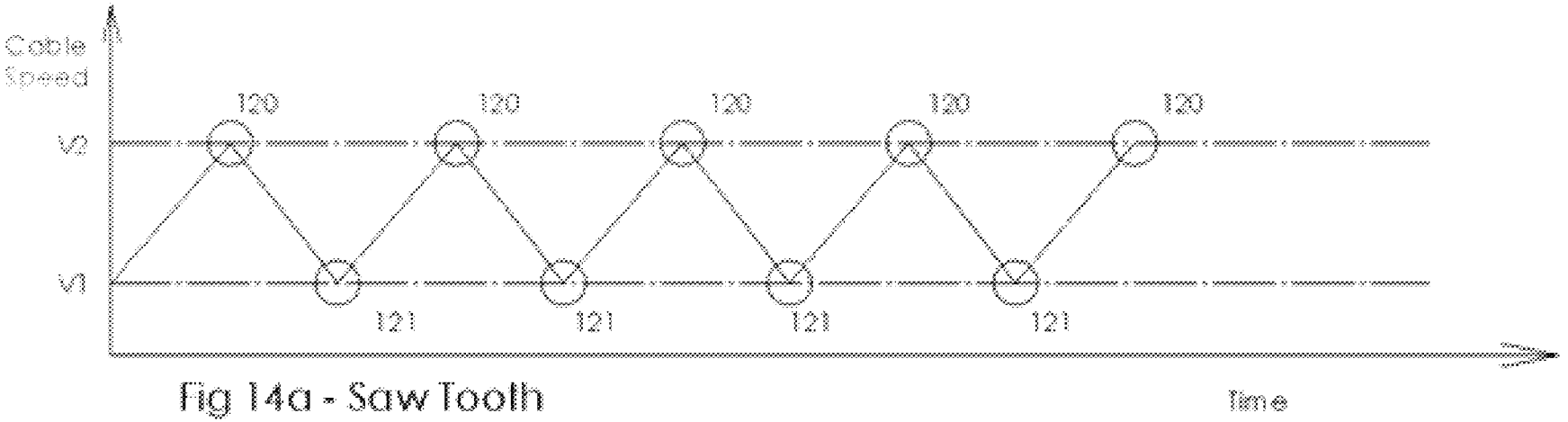
FIG. 14 gives an example of two possible speed profiles for the local cable loop
Figure 14:
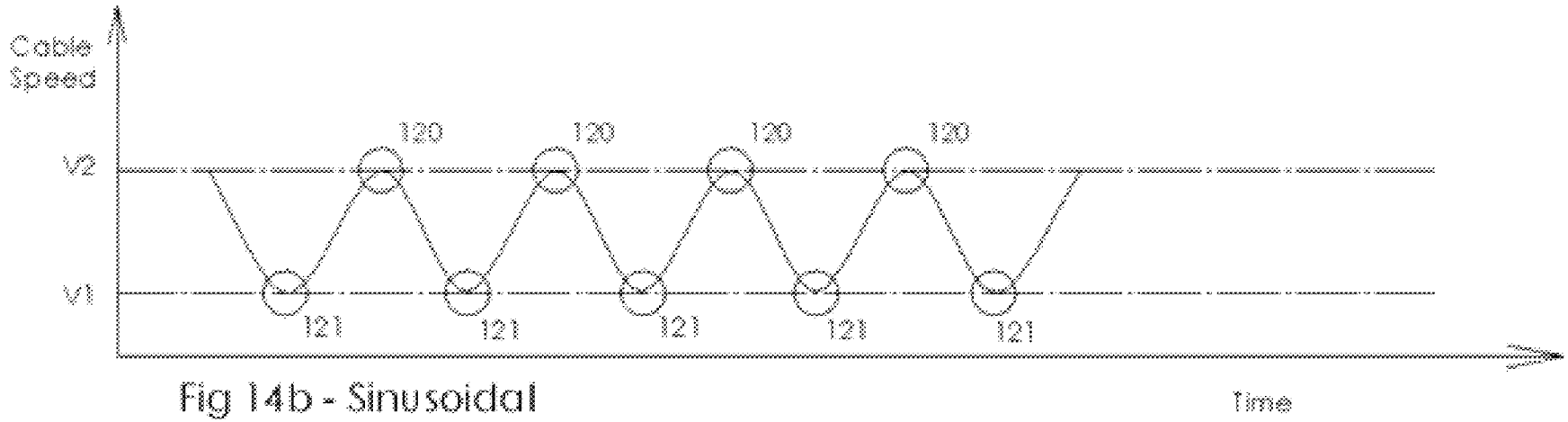

Cable 1 is powered by pulley 4 at constant speed, while cable 20, powered by pulley 18 has a variable speed, see FIG. 14.

The variable speed is constantly oscillating between a low value V1, and a high value V2. Preferentially, V1 is at or near the crawling speed of the stations and V2 is the line speed of the direct cable 1. This oscillation can have the form of a saw tooth or a sinusoid, for example.

The vehicle possessing at least two independent gripping systems, 37 and 43, can switch to and from any local station to the direct route cable by switching the gripping at the appropriate times in each cycle. A vehicle can grip the local line, exactly at the appropriate point and time in the cycle, 120 when this line is at the high speed point, close to the direct route speed, and follow the line to the station. Upon arrival at the station, the grip is released from the local cable, and the vehicle is now travelling at very low speed, 121. After the passenger embarkation, performed in a local loop of a station at crawling speed, the vehicle re-grips the local cable for a precise acceleration out of the station and into the main line, ready to again grip the direct route cable.

The oscillation speed of the local cable is performed so that the maximum acceleration and deceleration is realistic for a vehicle to leave a station, perhaps 2 or 3 m $s^{-2}$ or return to a station from the main line. The system is run in a synchronous mode, so the times and switching points always match. The spacing between the stations are multiples of the "wavelength" of oscillation. In other words there would be a location between posts 22 and 23 where at times 120 the vehicle would be gripped to follow cable 20 to the station. The vehicle would arrive at the entrance to the station at times 121 where the grip could be released.

Such an embodiment has the advantage that the vehicle would remain semi-passive, only possessing the independent gripping systems, but the stations would be simple and short as in the more complex vehicle systems which are self-powered or possesses the special clutch. This is because the vehicle is dropped and picked up from the station at very low speed. Such a system does however require a good level of synchronisation to work. The vehicles can also only be inserted on the line with time intervals no shorter than the period of oscillation of the pulsed cable.

This last problem can be overcome by employing a second local pulsed cable, at for example, 180 degrees out of phase, to the first one. This would double the line capacity and allow the doubling of the number of vehicles inserted in the main line 1.

Any of the embodiments of the invention shown above will transform a conventional gondola lift into an autonomous very flexible transport system as described. It also has a very low foot print on the ground as the only connection to the ground are the towers typically 100 metres to 300 metres apart. The system can also operate at different heights above the ground and enter buildings on upper floors. It can cross rivers, major roads and railway tracks with little problems. It can climb mountains at very steep angles. It can operate with minimum human intervention virtually 24 hours a day. It can be automatically disinfected between users. It is fun to ride. It is the perfect transport system for urban areas in the 21st century.

What is claimed is:

1. A ropeway system comprising:

a suspension system comprising two powered substantially horizontal slide gripping actuators operating in a direction perpendicular to the line of travel of a ropeway vehicle and in opposition to each other, wherein each slide gripping actuator comprises an independent gripping system, wherein each of the two gripping systems is configured to move between a retracted and an extended position, and wherein one of the two gripping systems moves to the extended position to attach to one of at least two ropeway cables while the ropeway vehicle is suspended by the other of the two gripping systems from another of the at least two ropeway cables.

2. A system according to claim 1, wherein the at least two ropeway cables form a track, the first ropeway cable extending directly between two end embarking or disembarking stations of the track, and the second ropeway cable extending between intermediate embarking or disembarking stations or turning towers on the track, such that the first and second ropeway cables diverge substantially from being parallel to each other near each intermediate station.

3. A system according to claim 2, wherein at least one of the gripping systems comprise a powered drive capable of moving the ropeway vehicle along at least one of the cables.

4. A system according to claim 2, the ropeway vehicle having a center of gravity, wherein the gripping systems are configured such that a coordinated movement of both slide gripping actuators can in use transfer the center of gravity from being under the first cable to being under the second cable.

5. A system according to claim 2, wherein the at least two cables form at least a portion of a cable system having turn posts provided with turn sheaves, wherein the two independent gripping systems comprise a right gripping system and a left gripping system which in use allow the ropeway vehicle to make a right turn or a left turn without hitting the turning sheaves on the turn posts.

6. A system according to claim 2, further comprising:

a counterweight;

a powered slide operating in a substantial horizontal direction perpendicular to the line of travel of the vehicle;

a tilt sensor; and a controller;

the counterweight being provided on the powered slide, and the controller being adapted to control movement of the counterweight on the powered slide to reduce or cancel unwanted roll or tilt of the vehicle using signals from the tilt sensor, optionally or preferably in a closed loop control system.

7. A system according to claim 2, wherein the at least two cables comprise at least two cable loops.

* * * * *